US008553890B2

(12) United States Patent
Yokota

(10) Patent No.: US 8,553,890 B2
(45) Date of Patent: Oct. 8, 2013

(54) SOUND REPRODUCTION METHOD AND SOUND REPRODUCTION SYSTEM

(75) Inventor: Teppei Yokota, Chiba (JP)

(73) Assignee: Sony Corporation, Tokyo (JP)

( * ) Notice: Subject to any disclaimer, the term of this patent is extended or adjusted under 35 U.S.C. 154(b) by 1565 days.

(21) Appl. No.: 11/431,537

(22) Filed: May 11, 2006

(65) Prior Publication Data

US 2006/0269068 A1 Nov. 30, 2006

(30) Foreign Application Priority Data

May 13, 2005 (JP) ..... 2005-140515
Dec. 22, 2005 (JP) ..... 2005-368996

(51) Int. Cl.
*H04R 5/00* (2006.01)

(52) U.S. Cl.
USPC ..... 381/1

(58) Field of Classification Search
USPC ..... 381/1–4, 17–23, 27, 80, 77, 103, 61, 381/86, 300, 307, 99, 333, 335, 338, 182, 381/388, 390
See application file for complete search history.

(56) References Cited

U.S. PATENT DOCUMENTS 4,641,345 A * 2/1987 Takahashi ..... 381/86
4,932,060 A * 6/1990 Schreiber ..... 381/300
5,889,875 A * 3/1999 Caron et al. ..... 381/338
6,057,659 A * 5/2000 Akiyama et al. ..... 381/98
7,113,609 B1 * 9/2006 Neidich et al. ..... 381/305

FOREIGN PATENT DOCUMENTS

JP 61-95189 * 6/1986
JP 05-95591 4/1993

* cited by examiner

*Primary Examiner* — Lun-See Lao
(74) *Attorney, Agent, or Firm* — Finnegan, Henderson, Farabow, Garrett & Dunner, LLP

(57) ABSTRACT

A sound reproduction system includes low frequency speaker units for reproducing low frequency sounds by receiving audio signals on low frequency channels among a plurality of channels, and a holder for holding the low frequency speaker units so as to be disposed in the vicinity of both ears of a listener without being mounted on baffle boards so that sounds from front and back surfaces of diaphragms of the low frequency speaker units are added.

10 Claims, 16 Drawing Sheets

SOUND REPRODUCTION METHOD AND SOUND REPRODUCTION SYSTEM

CROSS REFERENCES TO RELATED APPLICATIONS

The present invention contains subject matter related to Japanese Patent Application JP 2005-140515 filed in the Japanese Patent Office on May 13, 2005, and Japanese Patent Application JP 2005-368996 filed in the Japanese Patent Office on Dec. 22, 2005, the entire contents of which are incorporated herein by reference.

BACKGROUND OF THE INVENTION

1. Field of the Invention

The present invention relates to a sound reproduction method and sound reproduction system suitable for use in playing back audio signals including a low frequency audio signal in multichannel sound reproduction such as 5.1-channel sound reproduction.

2. Description of the Related Art

Video-and-audio playback systems, called "home theater systems", are coming into widespread use. In the video-and-audio playback systems, by using relatively-large-screen displays to display video playback from, for example, DVDs (digital versatile discs), and, by recently employing 5.1-channel sound reproduction as multichannel reproduction for audio playback, exciting video and audio can be played back.

A 5.1-channel sound reproduction system needs four types of speakers, that is, front speakers, a center speaker, rear speakers, and a subwoofer. The subwoofer, which is used for low frequencies, originally reproduces a frequency range of 100 Hz or less. The other speakers reproduce frequencies from 100 Hz to 20 kHz.

Speaker arrangement of the related art in the 5.1-channel sound reproduction system is as shown in FIG. 21. Specifically, as shown in FIG. 21, in front of a listener 1, a front left channel speaker 2FL is disposed on the left side, a front right channel speaker 2FR is disposed on the right side, and a center channel speaker 2C is disposed opposing the listener 1.

Behind the listener 1, a rear left channel speaker 2RL is disposed on the left side and a rear right channel speaker 2RR is disposed on the right side. In addition, a subwoofer 2SW for an LFE (low frequency effect) channel (only for low frequencies) is disposed at an appropriate position.

These six speakers 2FL, 2FR, 2C, 2RL, 2RR, and 2SW are disposed at their positions, with them provided in speaker boxes. In general, in many cases, the six speakers around the listener 1 are disposed so that each (indicated by "ds") of distances between the listener 1 and the six speakers is, for example, approximately two meters.

In a sound reproduction system of the related art, speaker boxes each having a volume of, for example, approximately 15 liters, are used for left and right speakers. The speaker boxes have changed to small boxes each having a volume of approximately one liter. Left and right speakers for which such small boxes are used are also called "satellite speakers". Obviously, the left and right speakers do not reproduce any low frequencies. Accordingly, a speaker called a "subwoofer" only for low frequencies is additionally used in order to supplement the reproduction. As described above, when small boxes are used for the speakers other than the subwoofer, it is common that a cross-over frequency of an audio signal supplied to the subwoofer 2SW is 150 Hz, which is slightly higher than the frequency of 100 Hz. Nevertheless, the fact remains that the frequency of 150 Hz is considerably low.

By using a speaker system having the above-described arrangement to play back 5.1-channel audio signals from a DVD, obviously, sufficiently low frequency sounds are reproduced. In addition, since a reproduction channel is specially provided only for low frequency sounds, when a movie sound or the like is used as a sound source, uncommon deep bass resonates across an entire room, thus enabling the listener to have exciting realistic sensation.

In general, high frequency sounds are easily insulated. Accordingly, a single wall or door can considerably attenuate most of the high frequency sounds. However, sound insulation is not easy for low frequency sounds having, for example, 100 Hz or less, which are to be reproduced by the subwoofer. In many cases, in small houses, it is difficult for a room to have a size for insulating the low frequency sounds. In addition, in order for common 5.1-channel speaker arrangement to reproduce exciting sounds when enjoying DVD video and audio, a sound volume of approximately 90 dB or greater is necessary. In this reproduction, in particular, low frequency sounds, such as 50 Hz and 40 Hz, reproduced by the subwoofer, resonate to propagate in a wide range.

Therefore, there is a possibility that, when sounds are reproduced from the subwoofer in a room, the reproduced sounds reach not only the next room but also even upstairs and downstairs rooms, thus causing trouble. In particular, as the sounds have lower frequencies, it is more difficult to insulate the sounds. Using the subwoofer is a big problem in the housing situation in urban areas, so that it is actually difficult to sufficiently utilize the 5.1-channel sound reproduction system.

To solve this problem, Japanese Unexamined Patent Application Publication No. 05-95591 discloses a sound reproduction system in which intermediate and high frequency sounds are reproduced by using small speakers and low frequency sounds are reproduced in the vicinity of listener's ears by using a pair of low-frequency-sound headphones or bone conduction.

According to the sound reproduction system disclosed in Japanese Unexamined Patent Application Publication No. 05-95591, sound reproduction is performed, with low frequency sounds reproduced in the vicinity of listener's ears by using low-frequency-sound headphones or bone conduction. Thus, although the reproduced sounds can be heard as loud, the reproduced sounds can be prevented from being conducted to a neighboring house.

SUMMARY OF THE INVENTION

However, in the sound reproduction system disclosed in Japanese Unexamined Patent Application Publication No. 05-95591, for reproducing low frequency sounds in the vicinity of listener's ears, speakers are not used, but headphones or a vibrating object using bone conduction are used. It seems that low-frequency-sound audibility through the vibrating object other than the speaker is not so natural as to be generally accepted, though the audibility depends on each person. In addition, the listener needs to wear headphones or a headset for bone conduction, and this is a cumbersome.

In view of the above points, it is desirable to provide a sound reproduction method and sound reproduction system which use a speaker even for low frequency sound reproduction and which suppress conduction of low frequency sounds to a neighboring house, even if sounds are reproduced with a large sound volume.

To solve the above problems, according to an embodiment of the present invention, there is provided a sound reproduction system including at least one low frequency speaker unit for reproducing a low frequency sound by receiving an audio signal on a low frequency channel among a plurality of channels, and holding means for holding the low frequency speaker unit so as to be disposed in the vicinity of an ear of a listener without being mounted on a baffle board so that sounds emitted from front and back surfaces of a diaphragm of the low frequency speaker unit are added.

In the embodiment of the present invention, the low frequency speaker unit is held so as to be disposed in the vicinity of the ear of the listener. Thus, for the listener, reproduced sounds can be heard with a large sound volume.

Since the low frequency speaker unit is not mounted on the baffle board, reproduced low frequency sounds are emitted from the front and back surfaces of the diaphragm of the low frequency speaker unit. The sounds emitted from the front and back surfaces of the diaphragm of the low frequency speaker unit are reverse in phase. Thus, the sounds emitted from the front and back surfaces cancel each other, so that they are attenuated. In particular, as the reproduced sounds have lower frequencies, they have larger attenuation, so that low frequency sounds propagated to a neighboring house are remarkably reduced.

According to an embodiment of the present invention, even if a speaker is used even for reproducing a low frequency sound and sounds are reproduced with a large sound volume, the low frequency sound, which is propagated to a neighboring house, etc., can be remarkably reduced.

DESCRIPTION OF THE PREFERRED EMBODIMENTS

A sound reproduction system according to an embodiment of the present invention is described by exemplifying a case in which multichannel audio signals in accordance with the 5.1-channel system are played back, with reference to the accompanying drawings.

Figure 1:
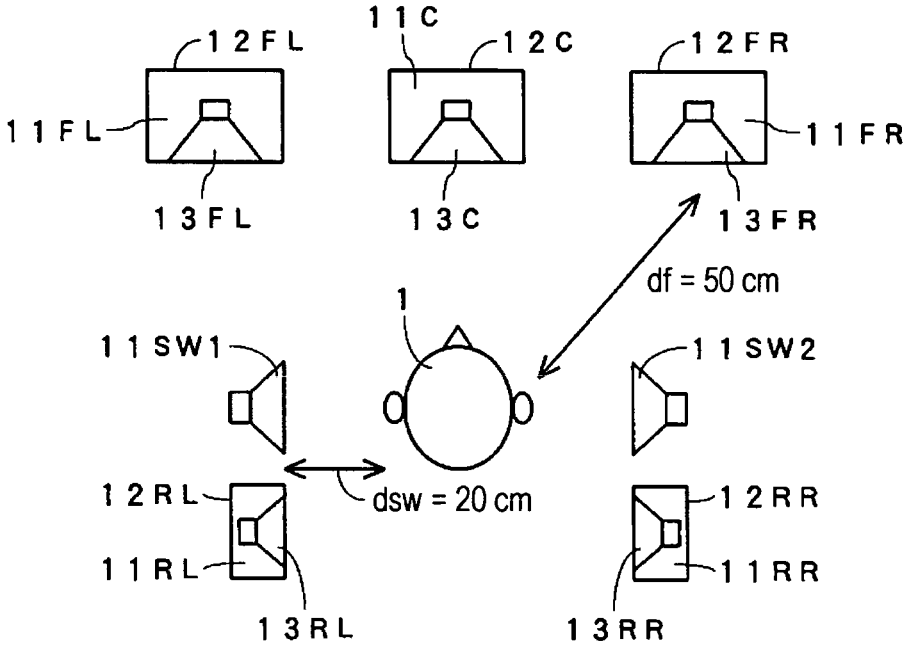
FIG. 1 is an illustration of speaker arrangement in a sound reproduction system according to an embodiment of the present invention.

FIG. 1 is an illustration of speaker arrangement in the sound reproduction system according to this embodiment.

Figure 21:
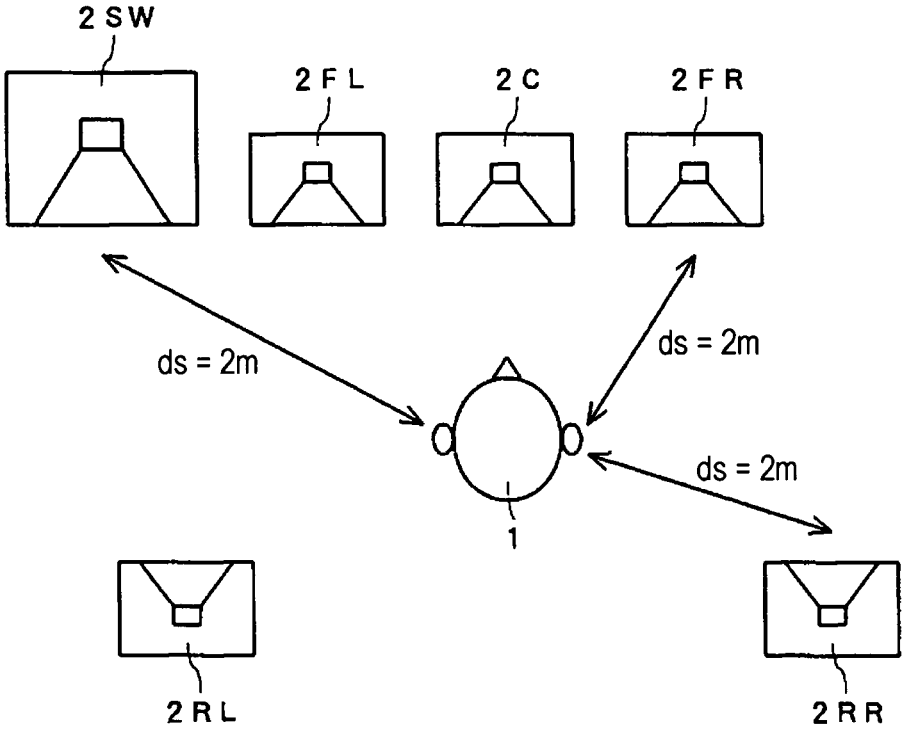
FIG. 21 is an illustration of a common example of speaker arrangement in a sound reproduction system of the related art.

As shown in FIG. 1, also in this embodiment, similarly to the case shown in FIG. 21, in front of a listener 1, a front left channel speaker 11FL is disposed on the left side, a front right channel speaker 11FR is disposed on the right side, and a center channel speaker 11C is disposed opposing the listener 1.

In the example shown in FIG. 1, the speakers 11FL, 11FR, and 11C are formed such that front surfaces of small speaker boxes 12FL, 12FR, and 12C each having, for example, one litter, are used as baffle boards and corresponding speaker units 13FL, 13FR, and 13C are mounted on the baffle boards. When it is not necessary to distinguish each of the speakers 11FL, 11FR, and 11C, each of them is hereinafter referred to as the "front speaker".

In addition, behind the listener 1, a rear left channel speaker 11Rl is disposed on the left side and a rear right channel speaker 11RR is disposed on the right side. When it is necessary to distinguish each of the speakers 11RL and 11RR, each of them is hereinafter referred to as the "rear speaker".

In the example shown in FIG. 1, the speakers 11RL and 11RR are formed so that front surfaces of speaker boxes 12RL and 12RR which are smaller than the small speaker boxes 12FL, 12FR, and 12C for the speakers 11FL, 11FR, and 11C are used as baffle boards and corresponding speaker units 13RL and 13RR are mounted on the baffle boards.

Accordingly, three front channel speakers 11FL, 11FR, and 11C and two rear channel speakers 11RL and 11RR may be similar in configuration and arrangement to those in the case of the related art. In this example, the configuration of a subwoofer greatly differs from that in the case of the related art.

In other words, in this embodiment, in the vicinity of the left and right ears of the listener 1, two subwoofers 11SW1 and 11SW2 are disposed with the head of the listener 1 provided therebetween so that their diaphragms oppose the ears but out of touch with the ears and head. The two subwoofers 11SW1 and 11SW2 are not accommodated as speaker units and are not mounted on baffle boards so that sounds emitted from the front and back surfaces of the diaphragms can be mixed.

The two subwoofers 11SW1 and 11SW2 are supplied in common with a low frequency signal on an LFE (low frequency effect) channel, and, from the subwoofers 11SW1 and 11SW2, low frequency sounds on the LFE channel can be emitted from the subwoofers 11SW1 and 11SW2.

As the result of the above arrangement, the low frequency sounds on the LFE channel are emitted in the vicinity of both ears of the listener 1, and are heard by the listener 1 with a large sound volume. However, at a position away from the listener 1, sounds from the front and back surfaces of the subwoofers 11SW1 and 11SW2 differ 180 degrees in phase and cancel each other, so that the sounds can hardly be heard. This can prevent occurrence of a situation in which low frequency sounds propagate to a neighboring house, causing a trouble, as in the case of the related art.

Figure 2:
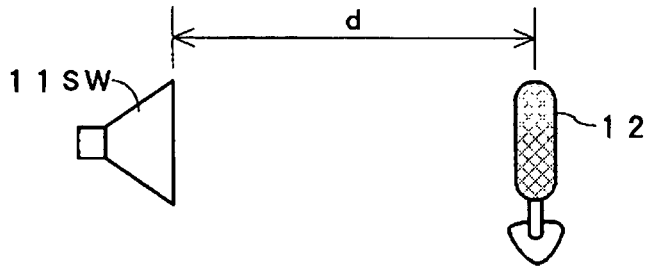
FIG. 2 is an illustration of an operation of a sound reproduction system according to an embodiment of the present invention.
Figure 3:
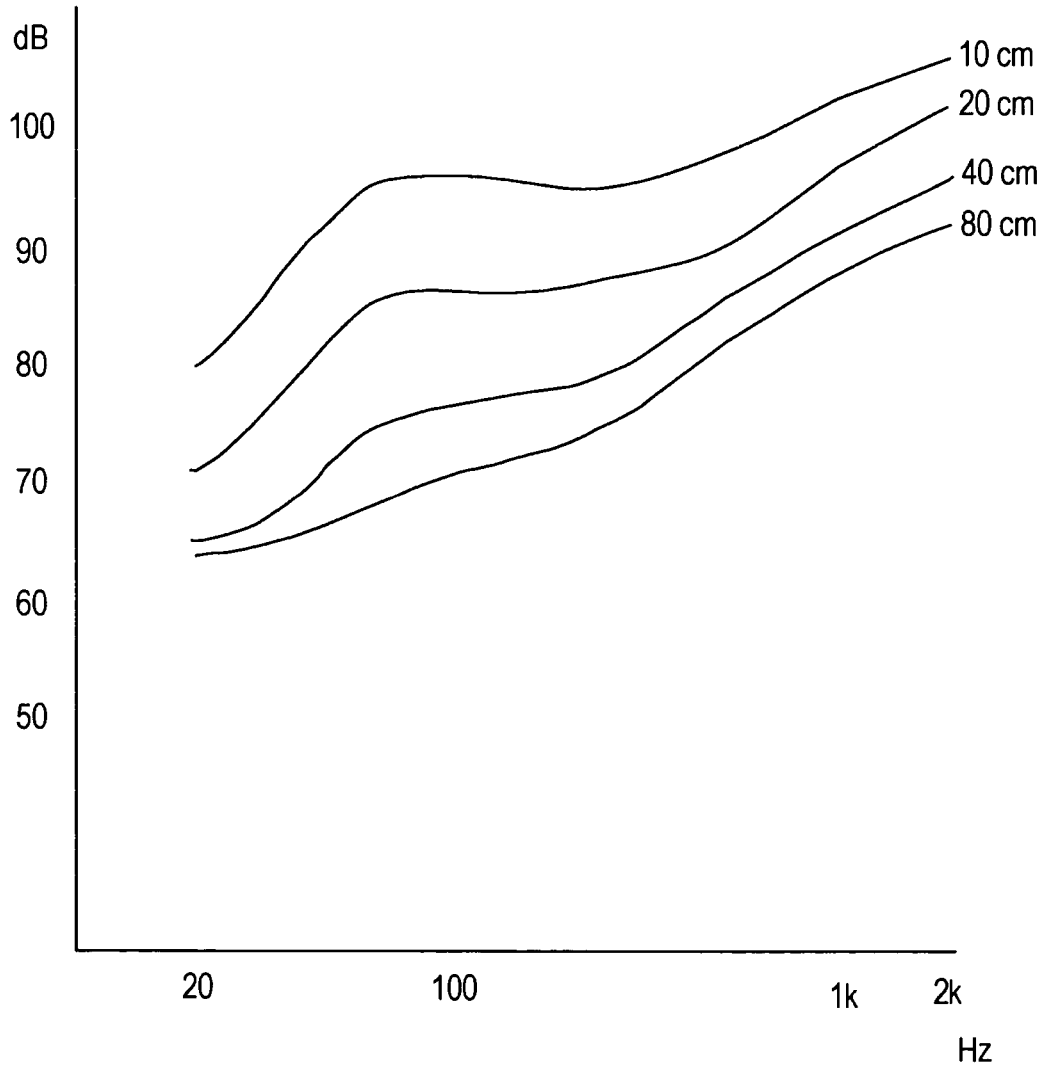
FIG. 3 is a graph illustrating an operation of a sound reproduction system according to an embodiment of the present invention.

In order to confirm attenuation in low frequency sound, in an anechoic room, as shown in FIG. 2, a sound from a subwoofer speaker unit 11SW having a diameter of, for example, 17 centimeters, was collected by a microphone 12 at a distance d from the speaker unit 11SW, and frequency characteristics of the sound pressure level of the sound were measured. Results of the measurement are as shown in FIG. 3. In this case, the speaker unit 11SW was not accommodated in a box and is not mounted on a baffle board.

The four frequency characteristic curves 21, 22, 23, and 24 shown in FIG. 3 were respectively obtained when d=10, d=20, d=40, d=80 (centimeters), where d represents the distance between the speaker unit 11SW and the microphone 12.

As is clear from FIG. 3, it is confirmed that, when the speaker unit 11SW is not provided in a speaker box, sound equal to 1 kHz or less considerably attenuates, and it is confirmed that, as sound has a lower frequency, attenuation of the sound is greater.

In this embodiment, each (indicated by "dsw") of distances between two subwoofers 11SW1 and 11SW2 and the left and right ears of the listener 1 is a distance in which low frequency sound can be traveled to the ears of the listener 1 without being so attenuated. In this example, the distance dsw is approximately 20 centimeters.

For example, in the case of the related art described with reference to FIG. 21, the distance between the subwoofer 2SW and the left ear of the listener 1 is 2 meters. Unlike that, in the embodiment in FIG. 1, each distance between the subwoofers 11SW1 and 11SW2 and both ears of the listener 1 is 20 centimeters. Accordingly, compared with the case of the related art, in this embodiment, the distance is 1/10.

Therefore, in this embodiment, energy necessary for the listener 1 to feel the same sound pressure may be 1/100 compared with the case of the related art. In other words, if the case of the related art needs a 100-watt amplifier, in this embodiment, by using even a 1-watt amplifier, the listener 1 can feel the same sound pressure.

This embodiment has small sound diffusion due to only a difference in audio signal output supplied to the speakers. Furthermore, regarding low frequency sounds having, for example, 20 Hz, 30 Hz, and 40 Hz, they cancel mutually in phase, so that sounds can hardly be heard except the vicinity of the subwoofers 11SW1 and 11SW2. Nevertheless, exciting sound effects included in DVD video can be obtained by recording large energy in a low frequency range. Thus, an advantage of sound insulation is enhanced.

In the above-described configuration, a sufficient advantage is obtained when low frequency sounds are noted and only the low frequency sounds are attenuated. However, in this embodiment, not only for low frequency sounds reproduced by the subwoofers 11SW1 and 11SW2, but also for overall frequency sounds, the advantage of sound insulation can be obtained.

In other words, by decreasing the distances of the other speakers other than each subwoofer to either ear of the listener 1, emission energy in the overall frequency sounds can be decreased, thus contributing sound insulation.

In particular, it is effective to dispose also the rear speakers 11RL and 11RR in the vicinity of the ears of the listener 1. As a sound source for the rear speakers 11RL and 11RR, a reverberant sound or the like from behind the listener 1 is originally used. Thus, by disposing the rear speakers 11RL and 11RR on the left and right sides behind the head of the listener 1 in a form in which each small speaker unit is accommodated in a small speaker box, localization and energy saving can be achieved.

In addition, although the arrangement of the front speakers 11FL, 11FR, and 11C needs consideration, by disposing each of the front speakers 11FL, 11FR, and 11C so as to be at a minimum distance of, for example, 50 centimeters from each ear of the listener 1, a total sound volume can be lowered, thus suppressing sound diffusion to the periphery.

In the above example, each sound pressure from the subwoofers 11SW1 and 11SW2 decreases 20 dB in such a manner that the distance dsw between each of the subwoofers 11SW1 and 11SW2 and the listener 1 is set to 20 centimeters from 2 meters in the case of the related art. This also applies to the rear speakers 11RL and 11RR. In addition, regarding relationships with the other front speakers 11FL, 11FR, and 11C, by setting the distance df between each of the front speakers 11FL, 11FR, and 11C and either ear of the listener 1 to 50 centimeters from 2 meters in the case of the related art, the sound pressure can be decreased as much as 12 dB.

Techniques in which the above points are considered and which dispose all the seven speakers so as to be close to the ears of the listener 1 include a technique in which a chair having, for example, a massage chair structure, is provided with the speakers.

Figure 4:
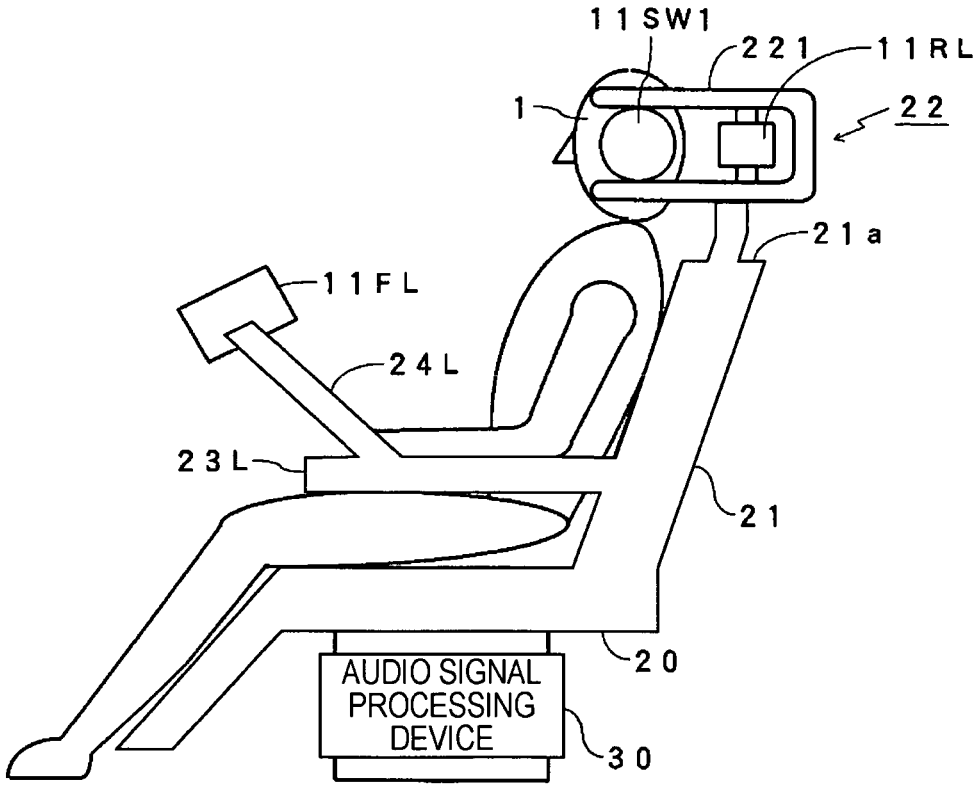
FIG. 4 is a side view illustrating a sound reproduction system according to an embodiment of the present invention.

FIG. 4 is an illustration of an example of the technique, and shows a sound reproduction system according to another embodiment of the present invention which has a structure in which the above seven speakers 11FL, 11FR, 11C, 11RL, 11RR, 11SW1, and 11SW2 are mounted on the massage chair.

In other words, in this example, for example, a chair 20 has an airplane-business-class-sheet structure. At a top 21*a* of a chair back 21 of the chair 20, a speaker holder 22 is mounted. The subwoofers 11SW1 and 11SW2, and the rear speakers 11RL and 11RR are mounted and held by the speaker holder 22.

Figure 5A:
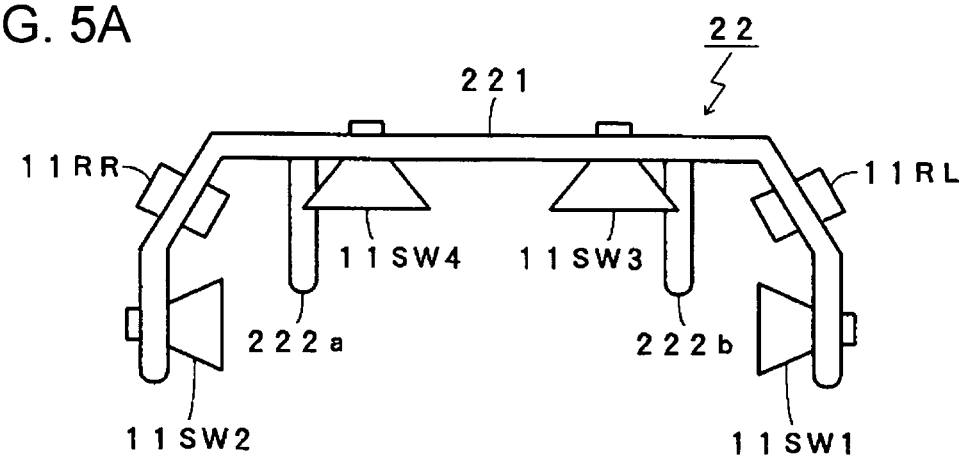
FIGS. 5A and 5B are illustrations of main components of the sound reproduction system shown in FIG. 4.
Figure 5B:
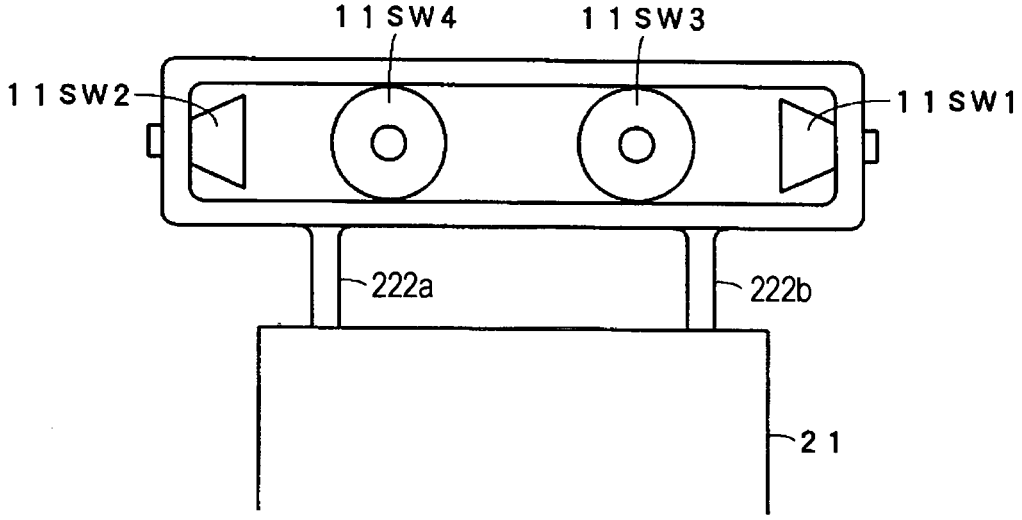

FIGS. 5A and 5B are illustrations of an example of the speaker holder 22. The speaker holder 22 is formed of, for example, a pipe 221 made of metal such as aluminum. As shown in FIG. 5B, the pipe 221 is formed in a flat ring. In a space formed by the ring, the subwoofers 11SW1 and 11SW2, and the rear speakers 11RL and 11RR, and auxiliary subwoofers 11SW3 and 11SW4 are fixedly held.

The auxiliary subwoofers 11SW3 and 11SW4 are disposed beside the ears of the listener 1. Since only the use of the subwoofers 11SW1 and 11SW2 may cause a case in which low frequency sounds are perceived as powerless in auditory sense, the auxiliary subwoofers 11SW3 and 11SW4 are used to supplement the insufficiency of power. Accordingly, auxiliary subwoofers 11SW3 and 11SW4 are not extremely important and necessary.

The pipe 221 is formed in a flat ring, and, as shown in FIG. 5A, the ring-shaped portion is formed so as to surround sides (opposing both ears) of the head and a back side of the head, excluding a front side of the face of the listener 1.

Setting legs 222*a* and 222*b* for setting to the chair back 21 of the chair 20 are bonded to the pipe 221. The setting legs 222*a* and 222*b* are used to set the speaker holder 22, for example, in a removable manner. Specifically, the top 21*a* of the chair back 21 of the chair 20 is provided with long holes (not shown) into which the setting legs 222*a* and 222*b* are inserted and fitted. The setting legs 222*a* and 222*b* are inserted and fitted into the long holes of the chair back 21, whereby the speaker holder 22 is fixed.

At positions of the pipe 221 which oppose both ears of the listener 1 when the listener 1 sits on the chair 20, the subwoofers 11SW1 and 11SW2 are held with them fixed to the pipe 221. In addition, behind the subwoofers 11SW1 and 11SW2, the rear speakers 11RL and 11RR whose speaker units are accommodated in speaker boxes are held with them fixed to the pipe 221. At positions of the pipe 221 behind the head of the listener 1, the auxiliary subwoofers 11SW3 and 11SW4 are held with them fixed to the pipe 221.

In this case, the speaker arrangement is configured so that, when the listener 1 sits on the chair 20, each of distances between each of the subwoofers 11SW1 to 11SW4 and the rear speakers 11RL and 11RR and the head (each ear) of the listener 1 is approximately 20 centimeters.

In this embodiment, also three front speakers 11FL, 11FR, and 11C are mounted on the chair 20.

In other words, the speaker 11FL for the front left channel is mounted at an end of a mounting arm 24L mounted on a left armrest 23L, for example, in a removable manner. In this case, the armrest 23L is provided with a mounting portion (not shown) on which the mounting arm 24L is removably mounted. The mounting arm 24L, with the speaker 11FL fixedly mounted at its end, is mounted on the mounting portion, whereby the speaker 11FL is set for the chair 20. In this case, the position of the speaker 11FL is placed so as not to hinder the listener 1 from viewing video displayed on a display screen.

Similarly, also the speaker 11FR (not shown) for the front right channel is fixedly mounted at an end of a right mounting arm, and the mounting arm is mounted on a mounting portion of a right armrest of the chair 20, whereby the speaker 11FR is set for the chair 20.

Similarly, also the speaker 11C (not shown) for the center channel is fixedly mounted at an end of a mounting arm, and the mounting arm is mounted on a mounting portion provided in either armrest, whereby the speaker 11C is set for the chair 20.

In this case, the mounting arms and their mounting portions are configured so that the positions of the speakers 11FL, 11FR, and 11C after they are set do not hinder the listener 1 from viewing video displayed on the display screen.

Corresponding channel audio signals for the speakers 11FL, 11FR, 11C, 11RL, 11RR, and 11SW1 to 11SW4 are supplied from an audio signal processing device 30 provided under the chair 20 through signal lines (speaker cables). After receiving a multichannel audio signal from, for example, a DVD player, the audio signal processing device 30 separates the received audio signal into audio signals on channels, amplifies the audio signals, and supplies the amplified signals to corresponding speakers on the channels.

In this case, the audio signal processing device 30 can be also configured to receive the signal from a multichannel-audio-signal supplying source, for example, a DVD player, through a signal cable. Accordingly, the DVD player and the chair 20 are connected by the signal cable. In this embodiment, by providing the DVD player with a functional unit that uses radio waves or emission to transmit a multichannel audio signal in a wireless manner, and providing the audio signal processing device 30 with a receiver that receives the wirelessly transmitted multichannel audio signal, the need for the signal cable between the DVD player and the chair 20 is eliminated.

Figure 6:
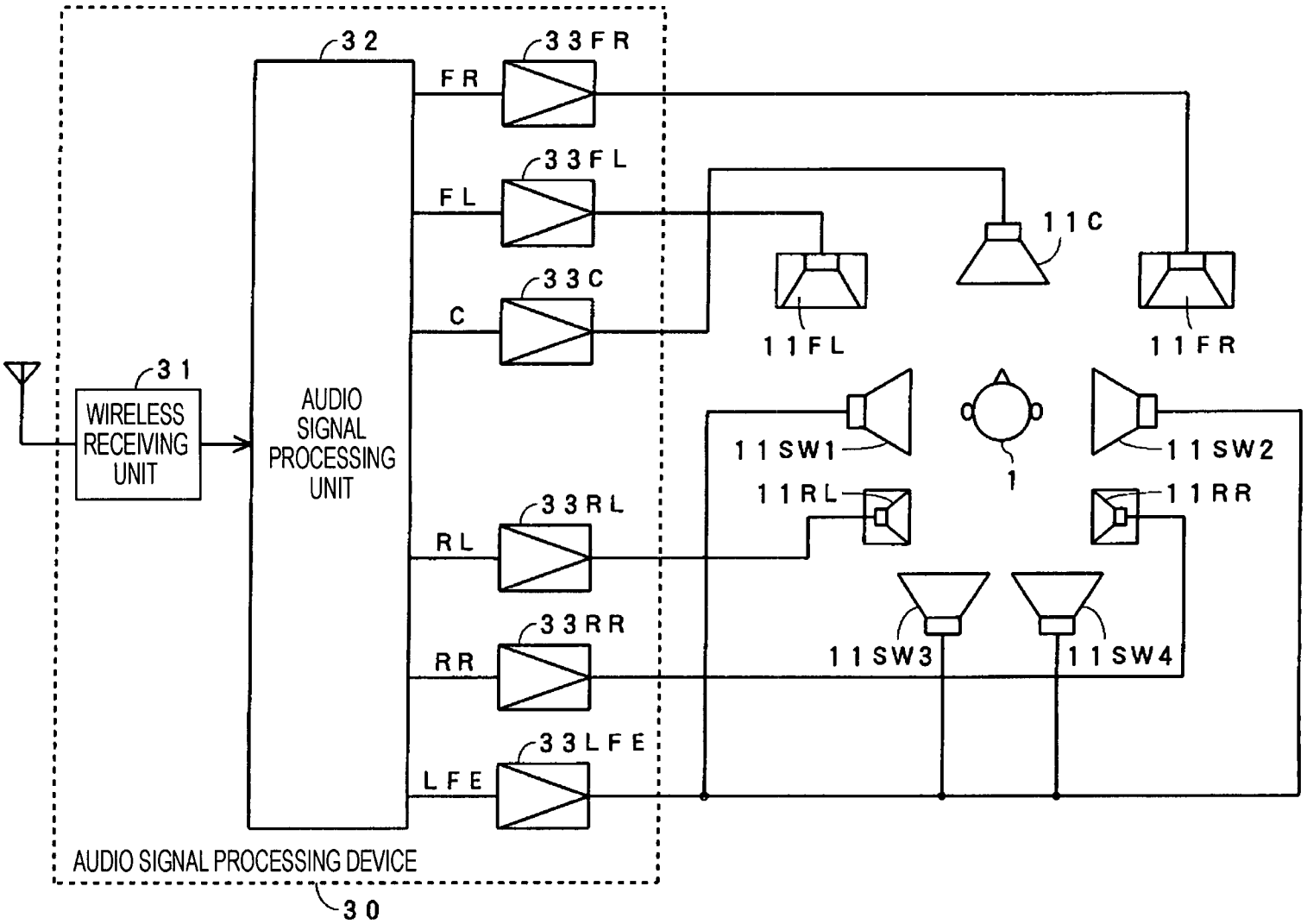
FIG. 6 is a block diagram showing an example of the configuration of the audio signal processing device shown in FIG. 4.

FIG. 6 is a block diagram showing an example of the configuration of the audio signal processing device 30 in this embodiment.

As shown in FIG. 6, the audio signal processing device 30 includes a wireless receiving unit 31, an audio signal processing unit 32, and output amplifiers 33FR, 33FL, 33C, 33RL, 33RR, and 33LFE for channels.

The wireless receiving unit 31 receives a multichannel audio signal transmitted in radio waves from, for example, the DVD player, and supplies the received signal to the audio signal processing unit 32. The audio signal processing unit 32 separates the supplied signal into audio signals on channels, and supplies the output amplifiers on corresponding channels.

In this case, after the multichannel audio signal transmitted from the DVD player is decoded by, for example, the DVD player, to restore audio signals on 5.1 channels, when the 5.1-channel audio signals are transmitted in multiplexed form, such as time division multiplexing or frequency multiplexing, the audio signal processing unit 32 performs multiplexing decoding to separate the multiplexed form signal into audio signals on channels.

When the multichannel audio signal transmitted from the DVD player is prior to channel decoding, the audio signal processing unit 32 performs channel decoding to extract audio signals on channels.

The separated audio signals on the channels are supplied to the speakers 11FR, 11FL, 11C, 11RL, 11RR, and 11SW1 to 11SW4 for corresponding channels through the output amplifiers 33FR, 33FL, 33C, 33RL, 33RR, and 33LFE for the corresponding channels. In this case, the audio signal on the LFE channel is supplied in common to four speakers SW1 to SW4 through the output amplifier 33LFE.

In the audio signal processing unit 32, delaying considering difference in distance to each speaker may be performed on the audio signals on the channels.

According to the sound reproduction system according to the embodiment in which the multichannel speakers are mounted on the chair 20 shown in FIG. 5, the listener 1 in a state sitting on the chair 20 can enjoy realistic multichannel sounds with a large sound volume, and leaks of sounds to the periphery can be considerably reduced.

In particular, in this embodiment, by disposing each subwoofer in the vicinity of the ears of the listener 1 without accommodating the subwoofer in a speaker box, leaking of deep bass to the next room can be considerably attenuated. In addition, as described above, by disposing the speakers on channel other than the subwoofer channel in the vicinity of the listener 1, the levels of audio signals supplied to the speakers on the channels can be lowered, whereby, for not only bass but also the entirety, the level of sound leaking to the periphery can be lowered. Accordingly, for example, even if DVD video is viewed at midnight, it can be enjoyed with a sufficient sound volume without worrying about the other.

In addition, since the low frequency speaker (subwoofer) is disposed in the vicinity of one ear of the listener 1, audio signal output power can be set to approximately 1/100 compared with the case of the related case, thus enabling energy saving, and the cost necessary for hardware (output amplifiers) can be considerably reduced. A feature in which small power is sufficient for outputting the audio signals also provides an advantage in that, as the above speakers, thin, light, and inexpensive speakers which do not need any large strokes can be used. In addition, reduction in audio output power decreases generated heat, and can achieve reduction in size of devices such as a power supply. Thus, each speaker can be also battery-driven, so that the speaker can be embedded in a design of a chair or the like.

In addition, as described above, by using radio waves or light to transmit audio signal outputs from a source, such as a DVD player, of a multichannel audio signal, the DVD player or the like and the sound reproduction system have no wires provided therebetween. Accordingly, an advantage is obtained in that the chair 20 in a state provided with the sound reproduction system can be freely moved.

Therefore, advantages are obtained in that power saving in the sound reproduction system can be realized in the entirety, and in that a sound reproduction system for reducing noise to the periphery without decreasing satisfaction of a listener can be provided.

If an ordinary soundproof window has performance of attenuating 45 dB at 5 kHz, the performance decreases 36 dB at 1 kHz and 20 dB at 100 kHz. Moreover, the attenuation is much less at a frequency equal to 50 Hz or less. Thus, the soundproof effect of the subwoofer in this embodiment is remarkable. Considering that playback of video and audio is enjoyed by performing even room soundproof construction, cost effectiveness caused by the saving is very significant.

Figure 7:
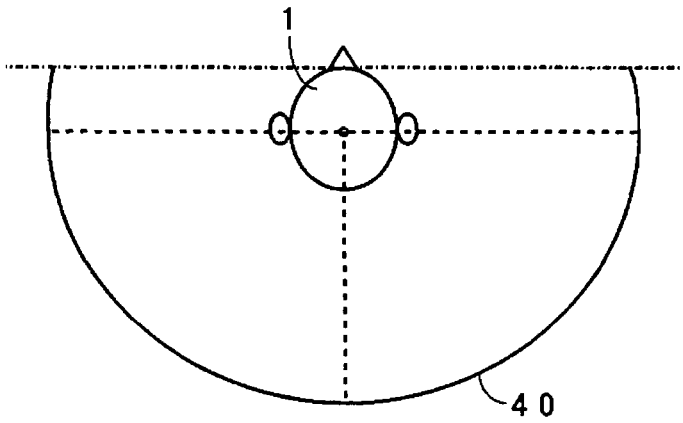
FIG. 7 is an illustration of a sound reproduction system according to an embodiment of the present invention.

In the above embodiment, the subwoofers 11SW1 and 11SW2 for reproducing low frequency sounds are provided at positions opposing the ears of the listener. Thus, low frequency sounds efficiently reach the listener. However, the positions of the subwoofers 11SW1 and 11SW2 are not limited to the positions opposing the ears of the listener. For example, as shown in FIG. 7, each subwoofer may be provided at any of positions within a sphere having a radius that is, for example, dsw. It is not preferable to dispose each subwoofer in a space anterior to the face of the listener 1. As shown in FIG. 7, it is preferable to dispose the subwoofer in a space posterior to the face of the listener 1.

Other Embodiments

In the above embodiment, as front speakers, in addition to the speakers for the front left channel and the front right channel, the center channel speaker 11C is also provided. Since the center channel speaker 11C is disposed opposing the listener 1, it may hinder the listener 1 from viewing video on the display screen.

Figure 8:
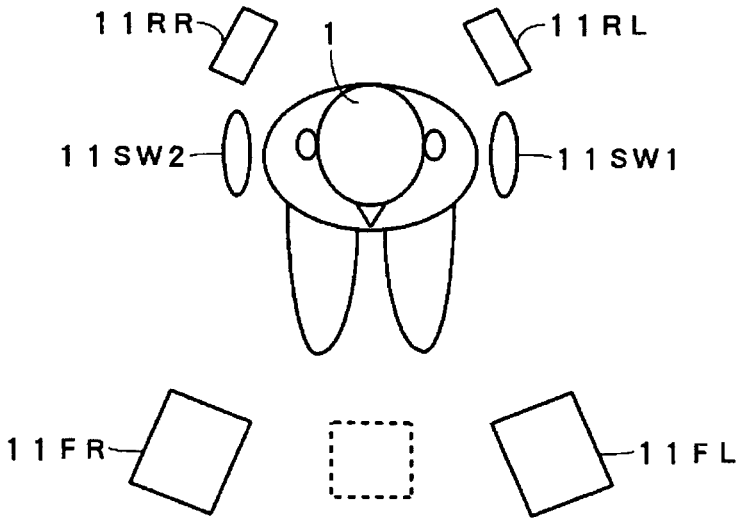
FIG. 8 is an illustration of a sound reproduction system according to an embodiment of the present invention.

Accordingly, as indicated by the broken line shown in FIG. 8, the center channel speaker 11C is not provided and this embodiment is configured so that, on the basis of sounds emitted from the front left channel speaker 11FL and the front right channel speaker 11FR, a virtual sound from the location indicated by the broken line can be perceived by the listener 1. In the example in FIG. 8, the auxiliary subwoofers 11SW3 and 11SW4 are not shown.

Figure 9:
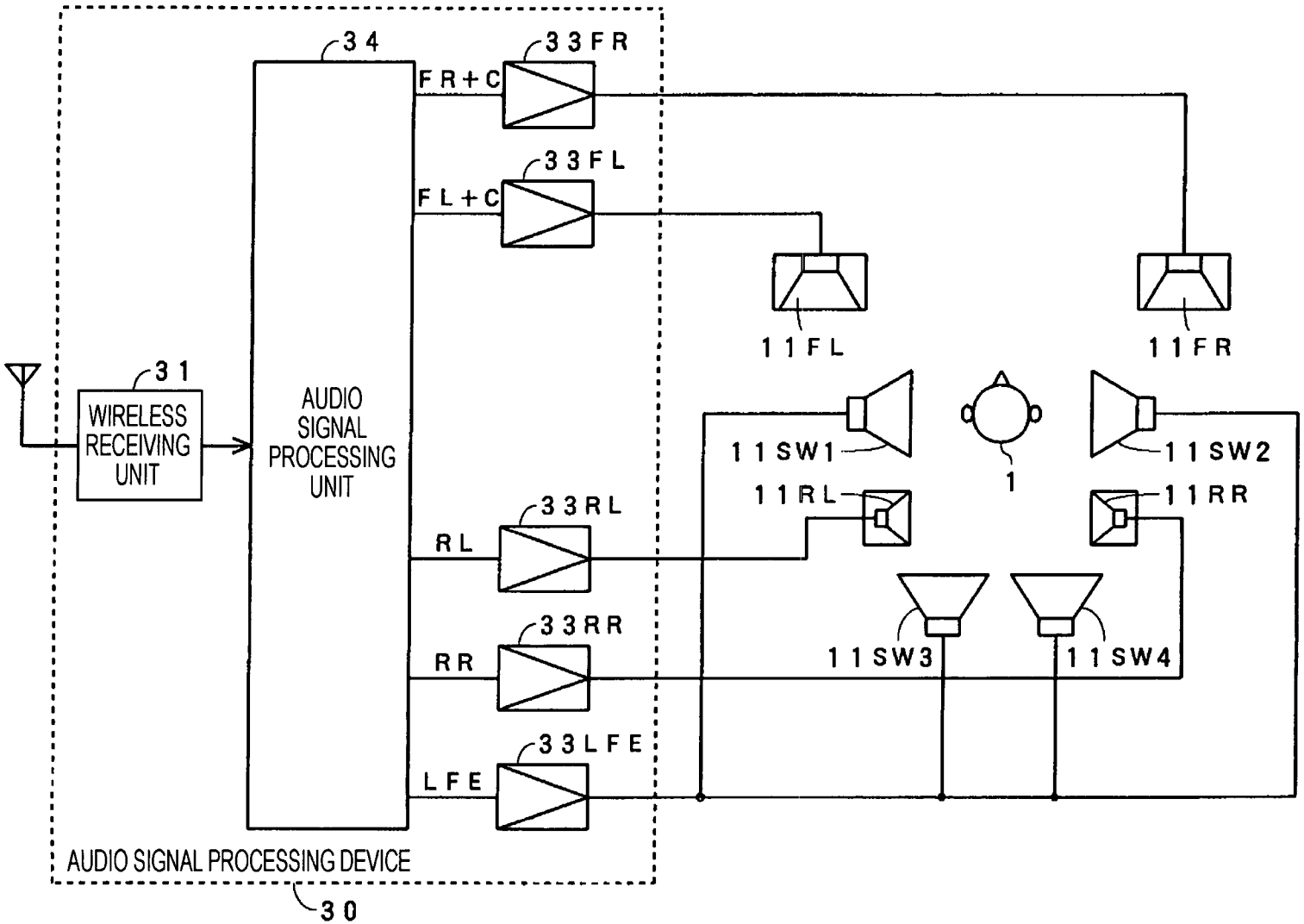
FIG. 9 is a block diagram showing an example of the configuration of the audio signal processing device shown in FIG. 8.

FIG. 9 is a block diagram showing an example of the configuration of the audio signal processing device 30 in this embodiment. In the example in FIG. 9, the audio signal processing device 30 includes no audio signal output amplifier 33C for the center channel since the center channel speaker 11C is not used.

Instead of the audio signal processing unit 32 shown in FIG. 6, an audio signal processing unit 34 is provided. The audio signal processing unit 34 is similar to the audio signal processing unit 32 in up to processing that separates or extracts an audio signal on each channel. However, the audio signal processing unit 34 differs from the audio signal processing unit 32 in that center-channel audio-signal component SC is mixed in front-left-channel audio signal SL and front-right-channel audio signal SR in the same phase and with the same level.

In other words, in this embodiment, signal SA supplied to the output amplifier 33FL and signal SB supplied to the output amplifier 33FR are represented by $$SA=SL+\alpha SC$$

$$SB=SR+\alpha SC$$

where $0\leq\alpha<1$.

In this manner, the front left channel speaker 11FL and the front right channel speaker 11FR can emit the sounds in the same phase and with the same level for the center channel. Thus, the listener 1 hears as if there were a sound source in the location indicated the broken line in FIG. 8.

Accordingly, in this embodiment, since the center channel sound can substantially be reproduced even if the center channel speaker 11C is not used, the listener 1 can view video in the front direction without being hindered by the center channel speaker, while hearing 5.1-channel sounds.

In the above embodiment, not only each speaker for the low frequency sound reproduction channel but also speakers for other channels are mounted on the chair. However, if leaking of only the low frequency sound is treated as an issue, only the speaker for the low frequency sound reproduction channel may be disposed in the vicinity of either ear of the listener 1 in a form mounted on the chair without being mounted on the baffle board as in the above embodiments.

In this case, the sound reproduction system may have a configuration including only the speakers for low frequency sound reproduction channels, and the speakers other than the speakers for low frequency sound reproduction channels are separately provided and appropriately disposed, thus forming a multichannel sound reproduction system.

Although the above embodiment has a configuration in which each speaker for the low frequency reproduction channel is disposed in the vicinity of either ear of the listener 1 in a form mounted on the chair, obviously, the configuration for disposing the speaker in the vicinity of either ear of the listener 1 is not limited to the form mounted on the chair.

Example of Other Subwoofer Holding Configuration

In the above embodiment, each of the subwoofers 11SW1 and 11SW2 is held in the speaker holder 22 fixed to the chair 20 in a so-called "bare state" without being accommodated in a speaker box and being mounted on a baffle board. The speaker holder 22 may not be fixed to the chair 20.

Figure 10:
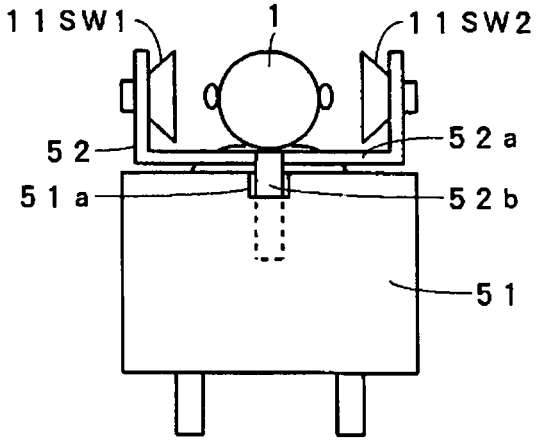
FIG. 10 is an illustration of other speaker arrangement in a sound reproduction system according to an embodiment of the present invention.
Figure 11:
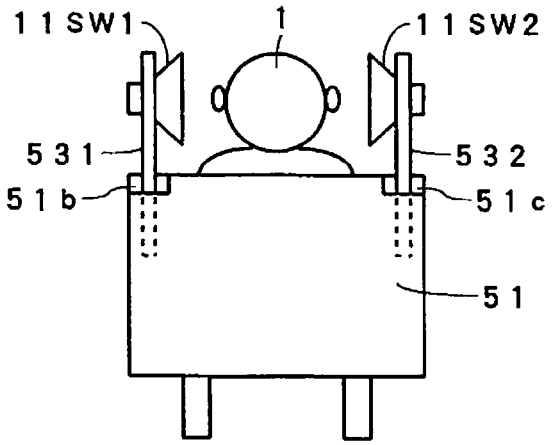
FIG. 11 is an illustration of other speaker arrangement in a sound reproduction system according to an embodiment of the present invention.

In each of the examples shown in FIGS. 10 and 11, similarly to the above embodiment, speaker holders for two subwoofers 11SW1 and 11SW2, which are formed of aluminum pipes, are removably mounted on a chair 51.

In the example in FIG. 10, the two subwoofers 11SW1 and 11SW2 are mounted at opposite ends of a T-shaped mounting arm 52A of a speaker holder 52. Both subwoofers 11SW1 and 11SW2 are mounted on the speaker holder 52 so that their diaphragms oppose each other, with a predetermined distance provided therebetween.

Also in this case, the distance between the diaphragm of the subwoofer 11SW1 and the diaphragm of the subwoofer 11SW2 is set so that, when the head of the listener 1 is inserted between both subwoofers 11SW1 and 11SW2, a distance between each of both ears of the listener 1 and each of the subwoofers 11SW1 and 11SW2 is the distance dsw described with reference to FIG. 1.

A central arm 52*b* of the T-shaped mounting arm 52A of the speaker holder 52 serves as a portion for mounting the speaker holder 52 on the chair 51 in such a manner that the portion is inserted into a speaker holder mounting hole 51*a* provided in the chair 51.

The speaker holder mounting hole 51*a* of the chair 51 is formed in a central portion in a shoulder-width direction of the listener 1 on a back board of the chair 51 when the listener 1 sits thereon.

In the example in FIG. 10, when the listener 1 listens to music by using the subwoofers 11SW1 and 11SW2, the central arm 52*b* of the speaker holder 52 is inserted into the speaker holder mounting hole 51*a* of the chair 51, whereby the subwoofers 11SW1 and 11SW2 can be mounted on the chair 51.

In the example in FIG. 10, when the listener 1 sits on the chair 51, each of the subwoofers 11SW1 and 11SW2 is disposed, in the vicinity of either ear of the listener 1, that is, at a position at a predetermined distance of dsw to either ear, so that the low frequency sound is reproduced with a sound volume sufficient for the listener 1, even if the original sound volume of the low frequency sound is small, and the low frequency sound is heard as noise to the periphery.

In the example in FIG. 11, the subwoofer 11SW1 is mounted on a speaker holder 531 and the subwoofer 11SW2 is mounted on a speaker holder 532. In an end portion, in a backboard of the chair 51, of a shoulder width of the listener 1 when the listener 1 sits on the chair 51, a speaker holder mounting hole 51*b* for inserting the speaker holder 531 in an engaging manner is formed. In the other end portion, in the backboard of the chair 51, of the shoulder width of the listener 1 when the listener 1 sits on the chair 51, a speaker holder mounting hole 51*c* for inserting the speaker holder 532 in an engaging manner is formed.

In the example in FIG. 11, when the listener 1 listens to music by using the subwoofers 11SW1 and 11SW2, the subwoofers 11SW1 and 11SW2 are mounted on the chair 51 by inserting the speaker holder 531 into the speaker holder mounting hole 51*b* and inserting the speaker holder 532 into the speaker holder mounting hole 51*c*.

The distance between the diaphragm of the subwoofer 11SW1 and the diaphragm of the subwoofer 11SW2, obtained when the speaker holders 531 and 532 are mounted on the chair 51, is set so that, when the head of the listener 1 is inserted between the subwoofers 11SW1 and 11SW2, a distance between each of the ears of the listener 1 and each of the subwoofers 11SW1 and 11SW2 is the distance dsw described with reference to FIG. 1.

Accordingly, also in the example in FIG. 11, when the listener 1 sits on the chair 51, each of the subwoofers 11SW1 and 11SW2 is disposed, in the vicinity of either ear of the listener 1, that is, at a position at a predetermined distance of dsw to either ear, so that the low frequency sound is reproduced with a sound volume sufficient for the listener 1, even if the original sound volume of the low frequency sound is small, and the low frequency sound is heard as noise to the periphery.

In the examples in FIGS. 10 and 11, when the chairs 51, which are of an ordinary type, are used, the speaker holder 52, and the speaker holders 531 and 532 can be removed from the chairs 51. Thus, the subwoofers 11SW1 and 11SW2 are not hindrances, thus providing good usability.

The subwoofers 11SW1 and 11SW2 are not limited to a form mounted on a chair, as described in the above examples.

Figure 12:
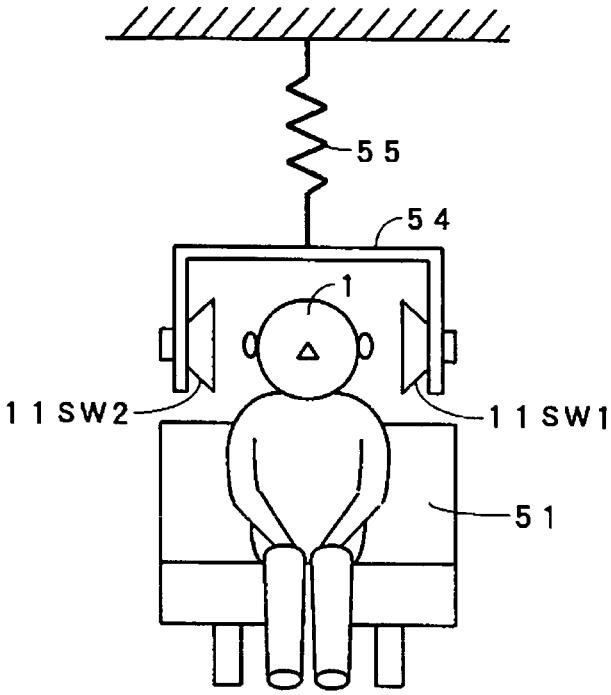
FIG. 12 is an illustration of other speaker arrangement in a sound reproduction system according to an embodiment of the present invention.

In the example shown in FIG. 12, a speaker holder 54 on which the subwoofers 11SW1 and 11SW2 are mounted so as to oppose each other having therebetween a distance similar to that in each of the examples in FIGS. 10 and 11 is suspended by a suspending member 55 from, for example, a ceiling.

In the example in FIG. 12, for example, the length of the suspending member 55 from the ceiling is adjustable, which is not shown. On the basis of the length adjustment, as shown in FIG. 12, each of the subwoofers 11SW1 and 11SW2 can be disposed, in the vicinity of either ear of the listener 1 when the listener 1 sits on the chair 51, that is, at a position at a predetermined distance of dsw to the ear.

Figure 13:
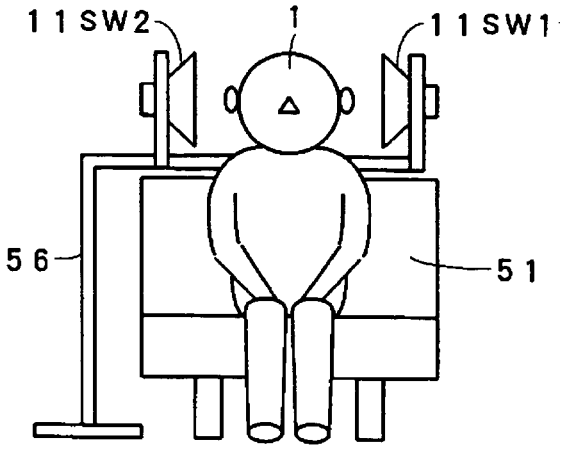
FIG. 13 is an illustration of other speaker arrangement in a sound reproduction system according to an embodiment of the present invention.

In addition, in the example shown in FIG. 13, a speaker holder 56 on which the subwoofers 11SW1 and 11SW2 are mounted so as to oppose each other having therebetween a distance similar to that in each of the examples in FIGS. 10 and 11 is in the form of a holding stand.

Figure 14:
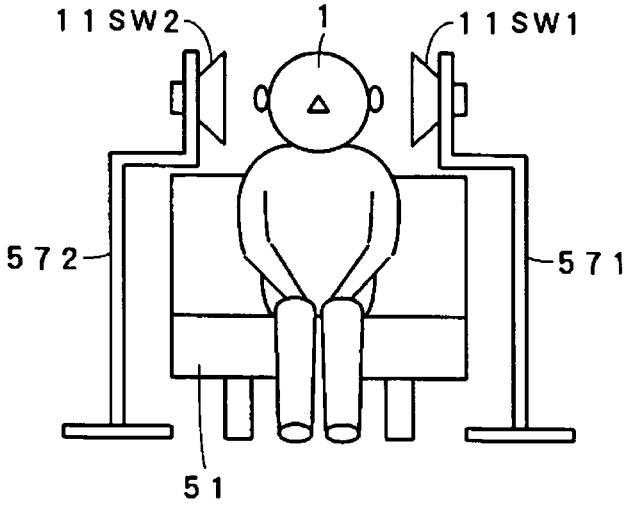
FIG. 14 is an illustration of other speaker arrangement in a sound reproduction system according to an embodiment of the present invention.

Similarly to the example in FIG. 13, in the example shown in FIG. 14, speaker holders are in the form of a holding stand. In the example in FIG. 14, the subwoofers 11SW1 and 11SW2 are respectively mounted on independent speaker holders 571 and 572 of a stand type.

Therefore, in the example in FIG. 13, by installing the speaker holder 56 in a predetermined location to the listener 1, the subwoofers 11SW1 and 11SW2 are correctly disposed similarly to the above examples in FIGS. 10 and 11.

However, since, in the example in FIG. 14, the speaker holders 571 and 572 are completely separate, each of the speaker holders 571 and 572 needs to be appropriately disposed by the listener 1.

Figure 15:
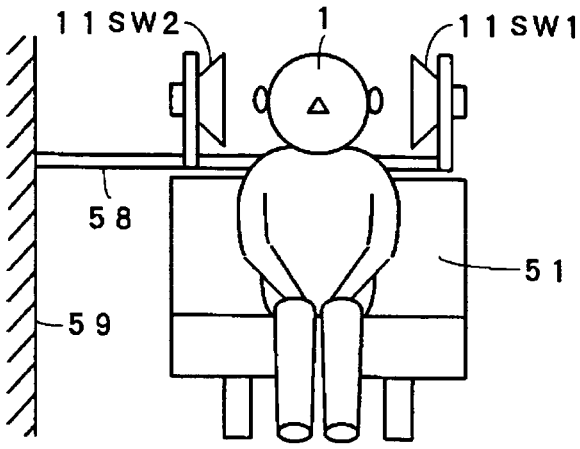
FIG. 15 is an illustration of other speaker arrangement in a sound reproduction system according to an embodiment of the present invention.

In the example shown in FIG. 15, a speaker holder 58 on which the subwoofers 11SW1 and 11SW2 are mounted so as to oppose each other having therebetween a distance similar to that in each of the examples in FIGS. 10 and 11 is designed to be mounted on a wall 59.

In the example in FIG. 15, similarly to the example in FIG. 13, the distance between the subwoofers 11SW1 and 11SW2 is fixed by the speaker holder 58. Accordingly, the listener 1 may place its head in the center between the subwoofers 11SW1 and 11SW2.

Figure 16A:
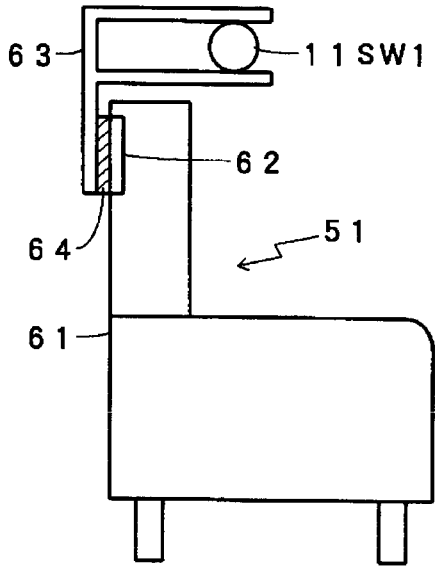
FIGS. 16A and 16B are illustrations of other speaker arrangement in a sound reproduction system according to an embodiment of the present invention.
Figure 16B:
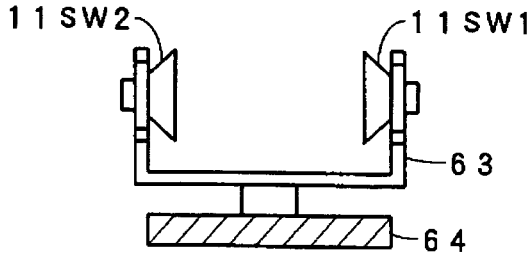

FIGS. 16A and 16B show another example of removably mounting a speaker holder on a chair. In the example in FIGS. 16A and 16B, an iron sheet 62 is embedded on a back side of a backboard portion 61 of the chair 51.

In addition, a magnet portion 64 is mounted by, for example, screw cramping, on a speaker holder 63 on which the subwoofers 11SW1 and 11SW2 are mounted so as to oppose each other having therebetween a distance similar to that in each of the examples in FIGS. 10 and 11. The speaker holder 63 is fixed to the backboard portion 61 of the chair 51 in such a manner that the magnet portion 64 is attracted by the iron sheet 62 on the backboard portion 61 of the chair 51 by magnetic attraction.

In the example in FIGS. 16A and 16B, in a state sitting on the chair 51, the listener 1 may place its head in the center between the subwoofers 11SW1 and 11SW2.

Although, in the foregoing description, examples of subwoofer arrangement for the listener 1 alone have been described, an embodiment of the present invention is also applicable to a case in which a plurality of listeners simultaneously enjoy music. FIGS. 17 to 20B illustrate examples of subwoofer arrangement for a plurality of listeners when they simultaneously enjoy music.

FIGS. 17, and 18A to 18C show an example of a sound reproduction system in which subwoofers are disposed in the vicinity of either ear of each of two listeners 1A and 1B. This example is an application of the example in FIGS. 16A and 16B.

Figure 17:
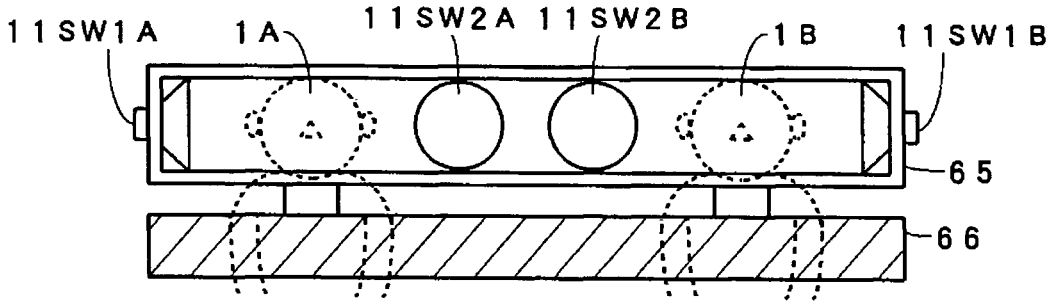
FIG. 17 is an illustration of other speaker arrangement in a sound reproduction system according to an embodiment of the present invention.

As shown in FIG. 17, two subwoofers 11SW1A and 11SW2A for a listener 1A and two subwoofers 11SW1B and 11SW2B for a listener 1B are mounted on a speaker holder 65 including, for example, an aluminum pipe.

A magnet portion 66 (see FIG. 17) that is attracted in magnetic attraction by an embedded iron sheet (not shown) similarly to that shown in FIG. 16A is mounted on the speaker holder 65 by, for example, screw cramping.

Obviously, the arrangement of the subwoofers 11SW1A and 11SW2A to the listener 1A and the arrangement of the subwoofers 11SW1B and 11SW2B to the listener 1B are similar to those in the above examples. However, in this example, as shown in FIG. 18B, diaphragms of the subwoofers 11SW2A and 11SW2B do not oppose diaphragms of the subwoofers 11SW1A and 11SW1B, whereby both subwoofers are disposed to emit sounds from behind the listeners 1A and 1B.

In other words, the subwoofers 11SW2A and 11SW2B are disposed so that directions of acoustic wave emission from their diaphragms are perpendicular to those of acoustic wave emission from the other subwoofers 11SW1A and 11SW1B.

Accordingly, assuming lines perpendicular in central position to the diaphragms of the subwoofers 11SW2A and 11SW2B, the positions of the subwoofers 11SW2A and 11SW2B are determined so that the positions of the lines oppose ears of both listeners and a distance between one ear of each listener and each line is the above distance dsw.

Figure 18A:
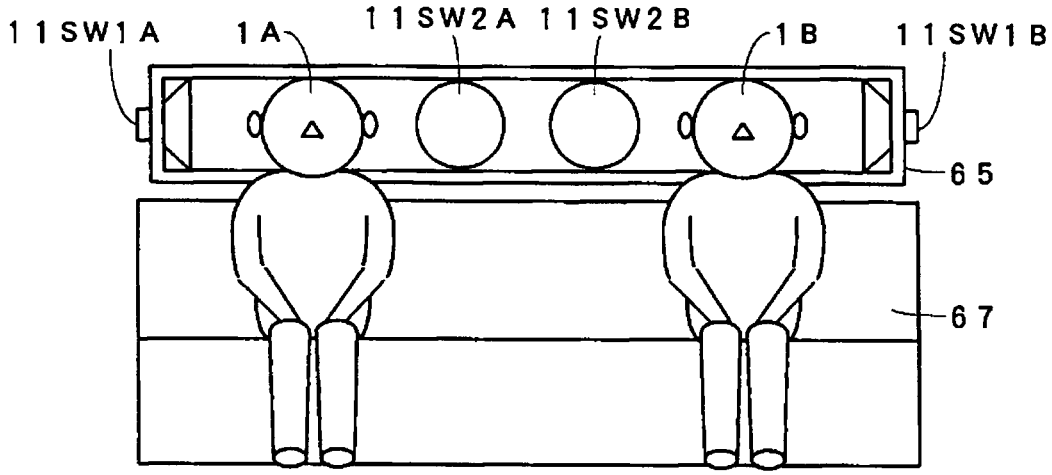
FIGS. 18A, 18B, and 18C are illustrations of other speaker arrangement in a sound reproduction system according to an embodiment of the present invention.
Figure 18B:
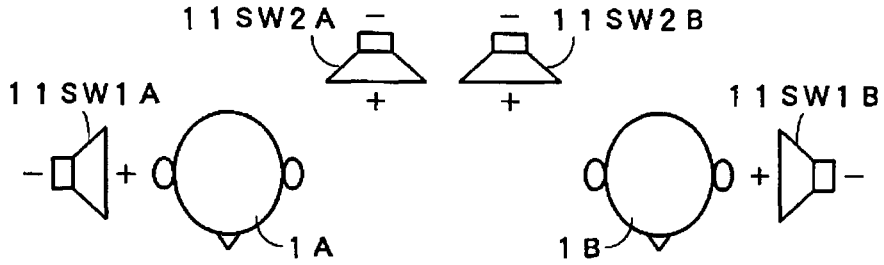

Therefore, a state in which both listeners 1A and 1B sit on a bench 64 is as shown in FIG. 18A. The subwoofers 11SW1A and 11SW2A provide reproduced low frequency sounds to the listener 1A, while the subwoofers 11SW1B and 11SW2B provide reproduced low frequency sounds to the listener 1B.

Figure 18C:
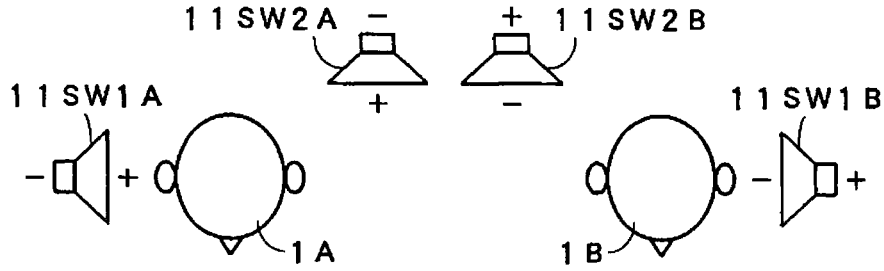

In this case, subwoofer audio signals are input to the subwoofers 11SW1A and 11SW2A so that acoustic waves from the diaphragms (front sides of subwoofer speaker units) of the subwoofers 11SW1A and 11SW2A reach both ears of the listener 1A in the same phase. Similarly, subwoofer audio signals are input to the subwoofers 11SW1B and 11SW2B (see FIG. 18B) so that acoustic waves from the diaphragms (front sides of subwoofer speaker units) of the subwoofers 11SW1B and 11SW2B reach both ears of the listener 1B in the same phase. In FIGS. 18B and 18C, the symbols "+" and "−" indicate acoustic wave phases, and acoustic waves are reverse in phase between the symbols "+" and "−".

In FIG. 18B, low frequency acoustic waves provided from two subwoofers are shown so as to be in the same phase between the listeners 1A and 1B. However, as shown in FIG. 18C, when the distance between the listeners 1A and 1B is relatively large, low frequency acoustic waves provided from two subwoofers may be in reverse phase.

Figure 19A:
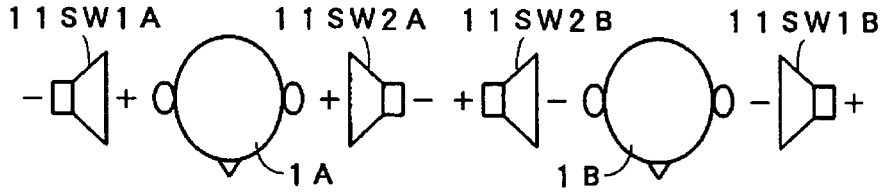
FIGS. 19A and 19B are illustrations of other speaker arrangement in a sound reproduction system according to an embodiment of the present invention.

In addition, as shown in FIG. 19A, obviously, by providing the diaphragms of the subwoofers 11SW1A and 11SW2A for the listener 1A so as to oppose each other, the subwoofers 11SW1A and 11SW2A may be disposed so that the head of the listener 1A is located between both, and, by providing the diaphragms of the subwoofers 11SW1B and 11SW2B for the listener 1B so as to oppose each other, the subwoofers 11SW1B and 11SW2B may be disposed so that the head of the listener 1B is located between both.

In the example in FIG. 19A, it is preferable that the subwoofer 11SW2A (for the listener 1A) and subwoofer 11SW2B (for the listener 1B) between the listeners 1A and 1B be disposed so that acoustic waves emitted from the backs (opposite to the diaphragms) of both cancel each other. Accordingly, in the example in FIG. 19A, subwoofer audio signals are supplied to corresponding subwoofers for the listeners 1A and 1B so that acoustic waves from the subwoofers 11SW1A and 11SW2A for the listener 1A are reverse in phase to acoustic waves from the subwoofers 11SW1B and 11SW2B for the listener 1B.

Figure 19B:
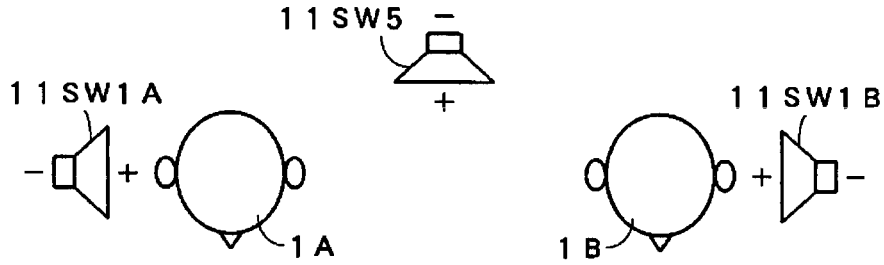

In addition, as shown in FIG. 19B, a subwoofer 11SW5 that is common to the listeners 1A and 1B may be provided between the listeners 1A and 1B. The example in FIG. 19B is preferable when the distance between the listeners 1A and 1B is small.

As shown in FIG. 19B, the subwoofer 11SW5 is provided behind the listeners 1A and 1B at the middle position between the listeners 1A and 1B. The position of the subwoofer 11SW5 is set so that, when assuming a line perpendicular to the diaphragm of the subwoofer 11SW5 in center position thereof, the position of the line opposes ears of the listeners 1A and 1B and each of distances between the ears of the listeners 1A and 1B and the line is the distance dsw.

The common subwoofer 11SW5 is disposed so that a direction of acoustic wave emission from its diaphragm is perpendicular to each of directions of acoustic wave emission from the diaphragms of the other subwoofers 11SW1A and 11SW1B.

Therefore, in the example in FIG. 19B, the arrangement of the subwoofers 11SW1A and 11SW5 for the listener 1A and the arrangement of the subwoofers 11SW1B and 11SW5 for the listener 1B are similar to the arrangement of the subwoofers 11SW1 and 11SW2 for the listener 1 in, for example, the example in FIG. 10.

In this case, as shown in FIG. 19B, subwoofer audio signals are input to three subwoofers 11SW1A, 11SW2A, and 11SW5 so that acoustic waves from the diaphragms (on the front sides of the subwoofers 11SW1A, 11SW2A, and 11SW5) of the subwoofers 11SW1A, 11SW2A, and 11SW5 reach ears of the listeners 1A and 1B in the same phase.

Figure 20A:
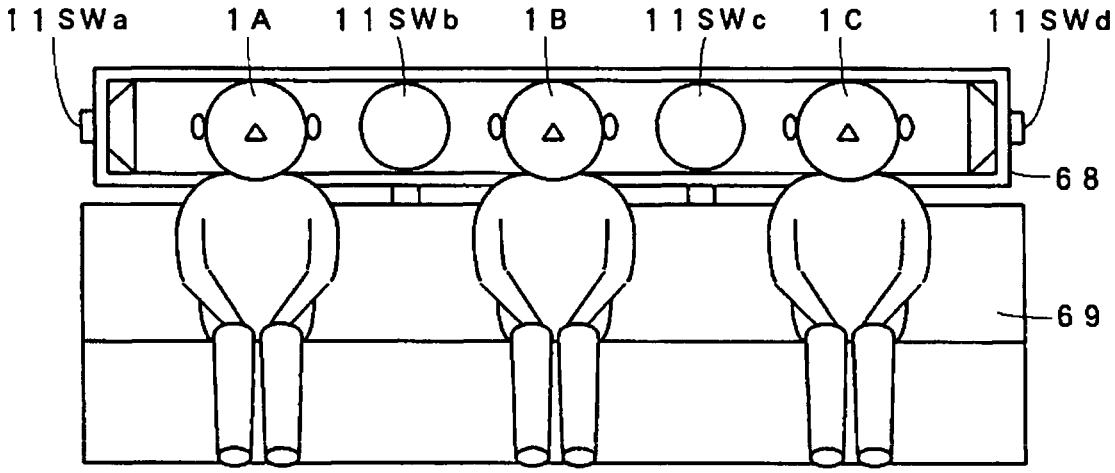
FIGS. 20A and 20B are illustrations other speaker arrangement in a sound reproduction system according to an embodiment of the present invention.
Figure 20B:
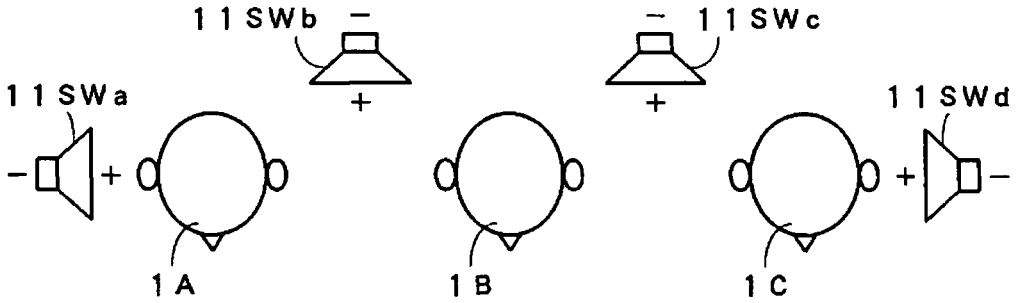

Next, FIGS. 20A and 20B show an application of each of the examples in FIGS. 17 and 19B, and shows an example of an sound reproduction system in which, for three listeners 1A, 1B, and 1C, subwoofers are disposed in the vicinity of ears of the listeners 1A, 1B, and 1C.

In the example in FIGS. 20A and 20B, four subwoofers 11SWa, 11SWb, 11SWc, and 11SWd are held by a speaker holder 68 similarly to the example in FIG. 17. A magnet portion (not shown) that is attracted in magnetic attraction by an iron sheet (not shown) embedded similarly to the example in FIGS. 16A and 16B is mounted on a backboard portion of the bench 69 shown in FIG. 20A.

In this example, two subwoofers for the listener 1A are subwoofers 11SWa and 11SWb, two subwoofers for the listener 1B are subwoofers 11SWb and 11SWc, and two subwoofers for the listener 1*c* are subwoofers 11SWc and 11SWd.

In other words, the subwoofer 11SWb is shared by the listeners 1A and 1B and is provided behind the listeners 1A and 1B in the middle position therebetween. The subwoofer 11SWc is shared by the listeners 1B and 1C and is provided behind the listeners 1B and 1C in the middle position therebetween.

The common subwoofers 11SWb and 11SWc are disposed so that directions of acoustic wave emission from their diaphragms are perpendicular to directions of acoustic wave emission from the diaphragms of the other subwoofers 11SWa and 11SWd.

The arrangement of both common subwoofers for each of the listeners 1A, 1B, and 1C is similar to that in the example in FIG. 19B.

In this case, as shown in FIG. 20B, subwoofer audio signals are input to the subwoofers 11SWa, 11SWb, 11SWc, and 11SWd so that acoustic waves from their diaphragms (front sides of them) reach ears of the listeners 1A, 1B, and 1C in the same phase.

In other words, the subwoofers 11SWb and 11SWc are disposed so that directions of acoustic wave emission from their diaphragms are perpendicular to directions of acoustic wave emission from the other subwoofers 11SWa and 11SWd.

The examples of the sound reproduction system shown in FIGS. 18A to 20B for a plurality of listeners each have a form in which a speaker holder is mounted on a chair by using a magnet. However, obviously, the sound reproduction system may have various forms such as a type having a speaker holder suspended from a ceiling as in the example in FIG. 12, a type having a speaker holder held with a mounting stand as in the examples in FIGS. 13 and 14, and a type having a speaker holder fixed to a wall.

In addition, although, in each of the examples in FIGS. 10 to 20B, subwoofer mounting has only been described, a rear speaker or the like may be mounted on the speaker holder in each example, if necessary, similarly to the above-described embodiments.

Other Embodiment and Modification

Mounting of low frequency reproducing speaker units so that sounds from the front and back surfaces of their diaphragms can be added is not limited to a case in which the speakers are mounted on a pipe as in the above-described embodiments. For example, a form may be employed in which the low frequency reproducing speaker units are mounted on a board having therein a large number of relatively large holes formed, and the holes can add sounds from the front and back surfaces of the diaphragms.

In addition, although, in the above-described embodiments, the case of a system that plays back audio signals on 5.1 channels has been described, an embodiment of the present invention is not limited to the 5.1-channel system, but is applicable to all sound reproduction systems in which audio signals on a plurality of channels other than a low frequency sound channel are played back.

It should be understood by those skilled in the art that various modifications, combinations, sub-combinations and alterations may occur depending on design requirements and other factors insofar as they are within the scope of the appended claims or the equivalents thereof.

What is claimed is:

1. A sound reproduction system comprising:

at least one low frequency speaker unit for reproducing a low frequency sound at or below 100 Hz, by receiving an audio signal on a low frequency channel among a plurality of channels; and a holding unit for holding said at least one low frequency speaker unit so as to be disposed within about 20 centimeters of an ear of a listener without being accommodated in an enclosure or without being mounted on a baffle so that a first sound emitted from a back surface of a diaphragm of said at least one low frequency speaker unit and having a reverse phase with a second sound emitted from a front surface of the diaphragm substantially cancels out the second sound so that a total sound resulting from combining the first and second sounds substantially attenuates outside of about 20 centimeters of the ear.

2. The sound reproduction system according to claim 1, wherein said at least one low frequency speaker unit is mounted by the holding unit on a chair on which the listener sits.

3. The sound reproduction system according to claim 1, wherein said at least one low frequency speaker unit is disposed by the holding unit in a spatial range behind the face of the listener.

4. The sound reproduction system according to claim 1, wherein the at least one low frequency speaker unit comprises at least two low frequency speaker units provided so as to oppose both ears of the listener.

5. The sound reproduction system according to claim 1, further comprising a speaker for a rear audio signal channel among the plurality of channels, wherein the speaker for the rear audio signal channel is held by the holding unit.

6. A sound reproduction system for playing back audio signals on a plurality of channels including a low frequency channel by using a plurality of speakers, the sound reproduction system comprising:

an audio signal processing unit for outputting, to the plurality of speakers, the audio signals on the plurality of channels including the low frequency channel, the low frequency channel including audio signals at or below 100 Hz;

a plurality of other speakers including speaker units for reproducing sounds by receiving, from the audio signal processing unit, audio signals on a plurality of channels different from the low frequency channel, the speaker units being mounted on baffles of the plurality of other speakers; and a low frequency speaker including a low frequency speaker unit for receiving an audio signal on the low frequency channel from the audio signal processing unit, the low frequency speaker unit being held so as to be disposed within about 20 centimeters of an ear of a listener without being accommodated in an enclosure or without being mounted on a baffle so that a first sound emitted from a back surface of a diaphragm of said low frequency speaker unit and having a reverse phase with a second sound emitted from a front surface of the diaphragm substantially cancels out the second sound so that a total sound resulting from combining the first and second sounds substantially attenuates outside of about 20 centimeters of the ear.

7. The sound reproduction system according to claim 6, wherein at least the low frequency speaker is mounted on a chair on which the listener sits.

8. A sound reproduction method for playing back audio signals on a plurality of channels including a low frequency channel by using a plurality of speakers, the sound reproduction method comprising the steps of:

reproducing sounds represented by audio signals on a plurality of channels different from the low frequency channel by using a plurality of other speakers including speaker units mounted on baffles of the plurality of other speakers; and reproducing a sound represented by an audio signal on the low frequency channel, including sound at or below 100 Hz, by using a low frequency speaker including a low frequency speaker unit held so as to be disposed within 20 centimeters of an ear of a listener without being accommodated in an enclosure or without being mounted on a baffle so that a first sound emitted from a back surface of a diaphragm of said low frequency speaker unit and having a reverse phase with a second sound emitted from a front surface of the diaphragm substantially cancels out the second sound so that a total sound resulting from combining the first and second sounds substantially attenuates outside of about 20 centimeters of the ear.

9. A sound reproduction system comprising:

at least one low frequency speaker unit for reproducing a low frequency sound, at or below 100 Hz, by receiving an audio signal on a low frequency channel among a plurality of channels; and a holder holding said at least one low frequency speaker unit so as to be disposed within about 20 centimeters of an ear of a listener without being accommodated in an enclosure or without being mounted on a baffle so that a first sound emitted from a back surface of a diaphragm of said at least one low frequency speaker unit and having a reverse phase with a second sound emitted from a front surface of the diaphragm substantially cancels out the second sound so that a total sound resulting from combining the first and second sounds substantially attenuates outside of about 20 centimeters of the ear.

10. A sound reproduction system for playing back audio signals on a plurality of channels including a low frequency channel by using a plurality of speakers, the sound reproduction system comprising:

an audio signal processor outputting, to the plurality of speakers, the audio signals on the plurality of channels including the low frequency channel, the low frequency channel including audio signals at or below 100 Hz;

a plurality of other speakers including speaker units for reproducing sounds by receiving, from the audio signal processor, audio signals on a plurality of channels different from the low frequency channel, the speaker units being mounted on baffles of the plurality of other speakers; and a low frequency speaker including a low frequency speaker unit for receiving an audio signal on the low frequency channel from the audio signal processor, the low frequency speaker unit being held so as to be disposed within about 20 centimeters of an ear of a listener without being accommodated in an enclosure or without being mounted on a baffle so that a first sound emitted from a back surface of a diaphragm of said low frequency speaker unit and having a reverse phase with a second sound emitted from a front surface of the diaphragm substantially cancels out the second sound so that a total sound resulting from combining the first and second sounds substantially attenuates outside of about 20 centimeters of the ear.

* * * * *